United States Patent [19]

Nahmias

[11] 4,030,098

[45] June 14, 1977

[54] METHOD AND MEANS FOR REDUCING REFLECTIONS OF ELECTROMAGNETIC WAVES

[75] Inventor: Maurice E. Nahmias, Ryswyk, Netherlands

[73] Assignee: The United States of America as represented by the Secretary of the Army, Washington, D.C.

[22] Filed: Mar. 26, 1962

[21] Appl. No.: 183,694

[52] U.S. Cl. ..... 343/18 A; 343/18 E

[51] Int. Cl.[2] ..... H01Q 17/00

[58] Field of Search ..... 343/700, 101, 18 A, 343/18 E, 18

[56] References Cited

UNITED STATES PATENTS 3,713,157 1/1973 August ..... 343/18 A

*Primary Examiner*—T.H. Tubbesing

*Attorney, Agent, or Firm*—Nathan Edelberg

EXEMPLARY CLAIM

1. A method for reducing the reflections of electromagnetic wave energy from material surfaces comprising applying to said material surface a radioactive substance for producing a cloud of electrons in the space enclosing said surface in sufficient quantity and so distributed as to produce a relatively uniform surface activity of an average value in the order of 10 curies per square centimeter.

8 Claims, 8 Drawing Figures

INVENTOR.
MAURICE E NAHMIAS
BY
Jack H Linscott
ATTORNEY

INVENTOR.
MAURICE E NAHMIAS
BY Jack H Linscott
ATTORNEY

METHOD AND MEANS FOR REDUCING REFLECTIONS OF ELECTROMAGNETIC WAVES

This invention relates to a method and means for reducing reflections of electromagnetic energy waves in the radio frequency portion of the spectrum from material surfaces, particularly from the surfaces of space vehicles.

Paints and other materials have been affixed to normally reflective surfaces for absorbing electromagnetic wave energy to attenuate the reflected energy. The thickness of the coating as a rule must at least equal an odd multiple of the quarter wave length of the electromagnetic energy to be absorbed. The range of frequencies of electromagnetic energy to be absorbed depends on the thickness of absorbing material affixed to the surface of the vehicle. Adding to the thickness of material applied adds to the weight of the vehicle and decreases the pay load that might be carried.

This invention distinguishes from the prior art devices of the same character in that the material applied to the surface in itself effects very little adsorption but because of its character, establishes in space a condition that makes the space adjacent to the surface absorbent to electromagnetic wave energy. Since the absorbent layer is in space surrounding the vehicle or in space apart from the normally reflective surface the thickness of the absorbent layer does not add to the weight of the vehicle, and a greater range of frequencies of electromagnetic wave energy may be absorbed. The present invention therefore obviates the disadvantages attending prior art structures of the same character and provides for absorption over a greater range of frequencies.

The desired results are accomplished by applying to the normally reflective surface, a radioactive material having an ionizing emission that will ionize the gaseous medium in the space adjacent the surface so treated.

It is generally known that an ionized gas attenuates radio frequency electromagnetic waves and that this attenuation is mainly caused by the free electrons in the plasma. The attenuation due to ions themselves is relative insignificant compared to that due to the electrons because of the relatively greater mass of the ion. (1836x the mass of the electron).

The electrons in the plasma are set in motion in the direction of the electric field of the electromagnetic wave. They vibrate with a range and velocity commensurate with the intensity of the electric field and of the period of the field. The electrons absorb energy from the electric field of the electromagnetic wave and is resident therein as kinetic energy. The electrons collide with molecules and atoms of the gaseous medium and lose kinetic energy thereto and ultimately recombine with ions to disappear as free electrons. The electrons thus operate as a transport agent for the energy from the electromagnetic wave to the molecule or atom which becomes the energy sink or reservoir. Any reradiated energy from molecules and atoms would then be at a more distant part of the frequency spectrum. The energy in the molecule or atom is in the form of heat and not readily reconvertible to electromagnetic wave energy for reradiation.

To the extent that the molecules and atoms receive and absorb energy from the electrons, the reflection of electromagnetic wave energy is attenuated. The degree of attenuation by absorption depends on the thickness of the absorbent layer, the density of the molecules and atoms in the space; the density of the electronsin the space and the frequency of the electromagnetic wave energy. The density of the molecules and atoms in free space is determined by the pressure and is inversely related to altitude above sea level. The density of electrons depends on the generating capacity of the coating material or the intensity of radioactivity. The thickness of the absorbent layer depends on the energy of the radioactive emanations, and the density of molecules and atoms. The frequencies involved are those used in devices for detection of vehicles such as radar frequencies.

The invention will be further described with reference to the accompanying drawings in which.

Figure 5:
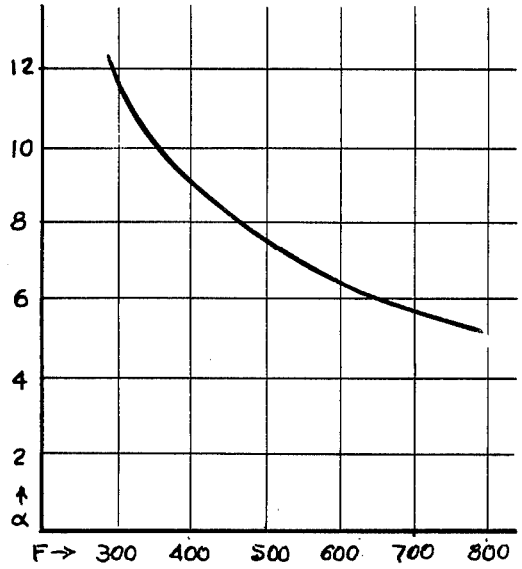
Figure 5A:
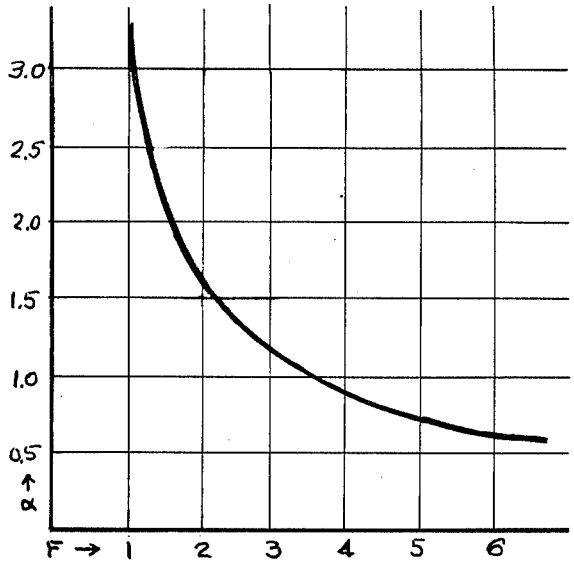
Figure 6:
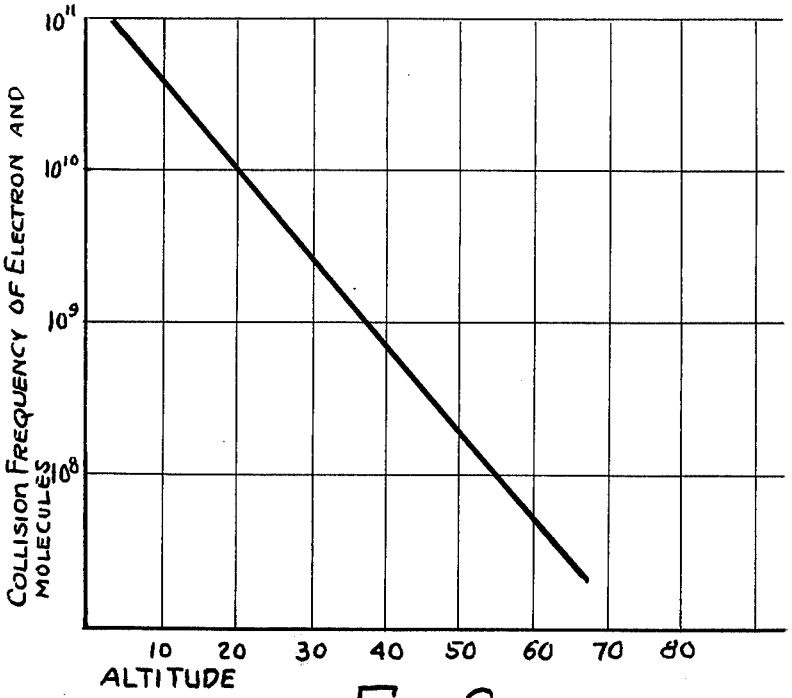
Figure 7:
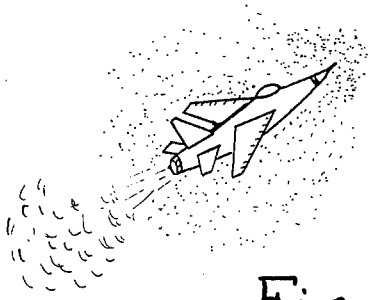

FIGS. 5 and 5*a* show the attentuation as a function of the frequency when the object is at the optimum altitude;

FIG. 6 shos the collision frequency of electrons with a neutral particle as a function of the altitude; and FIG. 7 discloses a space vehicle to which the coating material is affixed diagramatically illustrating the effect of radiactivity.

In priciple any radioactive substance which can produce an electron cloud in the space adjacent to the surface can be used. However, in practice use will be restricted to substances meeting the following requirements:

1. The radiation should have no adverse biological effects.

2. The half-life must be long enough for the substance to be able to be stored, without its activity being reduced;

3. The substance should be resistant to relatively high temperatures, for example, temperatures of about 500° C.

4. The substance should be available in sufficient quantities and at a reasonable price.

Of the known radioactive substances polonium 210 and strontium 90 are nearest to the filling the requirements listed. Of these strontium 90 is preferable, because the servicing of objects covered with polonium offer some biological risks, even incases where protection is provided.

Strontium 90 has a half-life of 28 years. It is a fission product and huge quantities are available at all nuclear reactor sites at nominal prices. It emits relatively soft beta particles having an energy of 0.5Mev with a range in water of 3 mm and in aluminum of 1 mm. By emission of a beta particle, the strontium 90 becomes yttrium 90 having a half life of 61 hours. Yttrium emits a beta particle having a maximum energy of 2.24 Mev and a range of 5 mm in aluminum. Yttrium 90 changes to zirconium 90 which is a stable product. Neither strontium 90 nor yttrium 90 are gamma ray emitters.

The combination of strontium 90 and its decay product yttrium 90 provides the advantage of long life (28 years)and short life long range particles. The coincidence of desired characteristics such as this does not happen in any other pure beta emitters.

The production of powerful strontium 90 radioactive sources has been particularly developed in textile industries, where they are used to make the atmosphere conductive to prevent accumulation of large static charges. To this end, strontium 90 has been incorporated in glass, synthetic resin and similar water insoluble substances and specific activities of about 1 curie per square centimeter have been obtained. A radiation of about $10^7$ roentgens per hour at the surface is obtained. The fabricated sources are quite thin as for example 0.2, can be baked on a metal surface and can withstand temperatures higher than 500° C.

For still higher activity per square centimeter these sources can be stacked in layers, the thickest attainable without self absorption being about 5 mm. A laminated structure thus obtained has a total activity of about 25 curies /cm$^{12}$.

Generally speaking an attenuation of high frequency energy waves, as used in radar, that produces a reduction of reflected energy so that the object observed is made uncertain is satisfactory. For example, a reduction of reflected electromagnetic energy to the extent that a bomber is confused as a fighter is adequate. An attenuation of radar returns shifts the moment of detection of the object and so shortens the time available for taking counter measures.

In practising the present invention care should be taken not to exaggerate the density of the electron cloud, because of the fact that at densities exceeding certain values for a given density of molecules and atoms the electrons do not deliver their energy and a greater portion of the impinging radio frequency waves are reflected by the electron plasma.

The electron density at which these undesirable reflections will occur is dependent on the frequency of the incident waves and at lower frequencies these reflections will occur at *k* lesser densities. The following table shows an estimate of maximum densities which can be used without danger of substantial reflection from the plasma.

| For f (in mc) | N must be smaller than |
|---|---|
| 70 | $6 \times 10^7$/cc |
| 1,000 | $1.2 \times 10^{10}$/cc |
| 3,000 | $1 \times 10^{11}$/cc |
| 10,000 | $1.2 \times 10^{12}$/cc |

In FIGS. 3,4,5 and 5*a* graphs illustrate the attenuation as a function of the altitude and the frequency, for electron density of $10^9$/cm$^3$. They show that the attenuation depends on the frequency of the electromagnetic wave, the altitude of the object and the optimum altitude. The altitude at which the attenuation is a maximum decreases with increasing frequencies.

The attenuation $\alpha$ in db/m along the propagation path of the electromagnetic wave is given by the known formula;

$$\alpha = 46\ N \frac{v}{v^2 + w^2}$$

In this formula N in the number of the electrons at equilibrium, $v$ is 15.5n T and represents the collisions frequency of the electrons with molecules, $n$ is the number of molecules per cm$^3$ and T is the absolute temperature in degrees Kelvin. $w = 2\ \pi f$ if $f$ is the frequency of the waves. The value of the $v$ is a function of height and can be found in FIG. 6.

An electron density N= $10^9$/cm$^3$ produces an attenuation of about 4 db per meter (see FIG. 3) if the frequency of the waves is 400 mc and the altitude is about 20 km. At this altitude the collisions frequency is about $10^{10}$ per second.

The range of the Beta particles having an energy of $$EmeV \text{ is } \frac{0.54E - 0.16}{d}$$

where $d$ is the density of the atmosphere. At a height of about 20 km, $d$ is approximately $0.06 \times 10^{-3}$ and if E is assumed to be 2.2 mev the maximum range of the Beta particles is 170 meters.

The attenuation being 4 db per meter if the electron density is $10^9$/cm$^3$ the total attenuation will be $170 \times 4 = 680$ db.

An attenuation of 10 db is sufficient to confuse a bomber with a fighter. This means that instead of an electron density of $10^9$/cm$^3$ giving an attenuation of 680 db an electron density of $$10^9 \times \frac{10}{680} = 1.5 \times 10^7/\text{cm}^3$$

is sufficient to confuse a bomber with a fighter.

For maintaining a specific electron density a production of electrons is required that supplies the losses due to recombination so that the production needed for a density N can be written as follows:

$$\text{production} = N^2 x \text{ recombination coefficient.}$$

To give an example we assume that the recombination coefficient is about $10^{-6}$ at the chosen altitude of 20 km.

The electron production to maintain the equilibrium value $1.5 \times 10^7$ is $(1.5 \times 10^7)^2 \times 10^{-6} = 2.2 \times 10^8$/cm$^3$ One Beta particle with energy of 2.2Mev produces $$2.2 \times 10^6/30 = 7 \times 10^4 \text{ electrons}$$

One curie of (Sr+ Y) 90 emits in a hemisphere $3.7 \times 10^{10}$ beta particles so that the number of electrons produced is $3.7 \times 10^{10} \times 7 \times 10^4 = 26 \times 10^{14}$ electrons One curie will therefore create in a half sphere of radius 170 meters an electron density of 265 electrons per cm$^3$.

Because of overlapping beta paths the electron density of a relatively small area source with activity of one curie per cm$^3$ will be much higher than 265 electrons /cm$^3$.

Figure 1:
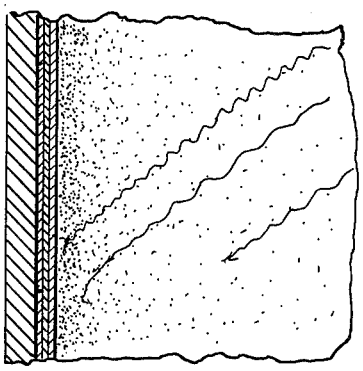
FIG. 1 is a cross-section of a surface and adjacent space, illustrating the applied radioactive substance and resulting production of electrons.

However, the electron density of the spherewill by no means be uniform but will vary from surface outwardly with distance as illustrated in FIG. 1. The greater density of the electrons will be highest immediately adjacent the surface of the radioactive material. It will taper of approximately as represented by the graph. There will thus be presented to the incident electromagnetic waves a density variation of electrons gradually increasing approximately logarithmically with distance, whereby the discontinuity of dielectric properties will be smoothed out and less chance for reflection taking place.

As heretofore mentioned the radioactive substance can be applied to singular points of the object to be protected, As shown in FIG. 1, the strontium 90 may be applied in layers or laminations up to a maximum thickness of 5 mm to obtain any desired radioactivity intensity within a wide range of radioactivity intensities.

Figure 2:
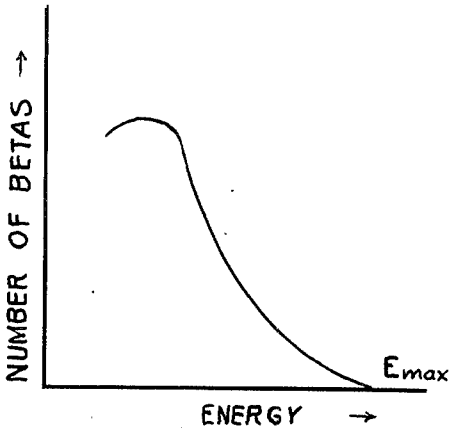
FIG. 2 is a curve representing the energy distribution of Beta particles emanating from strontium 90.
Figure 3:
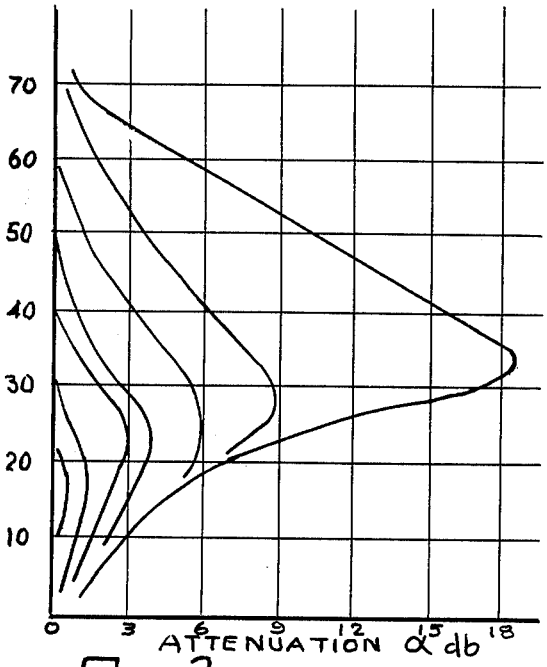
FIG. 3 shows the relation between the attenuation and the altitude for various frequencies, at the electron density of $10^9/cm^3$.
Figure 4:
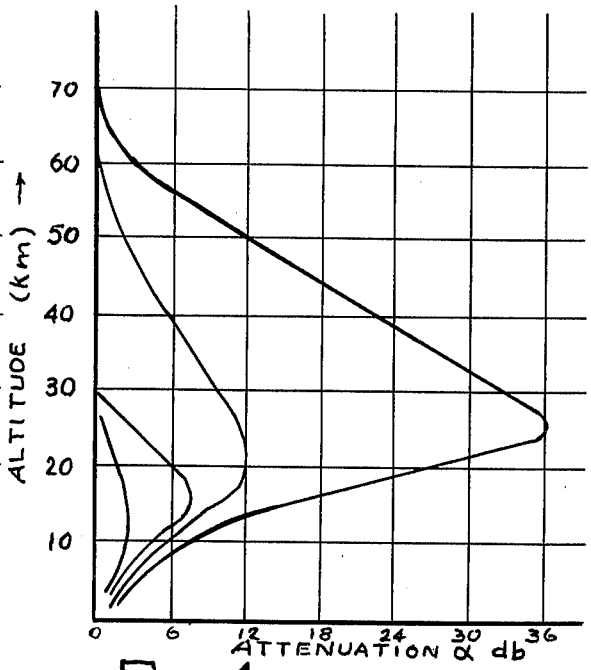
FIG. 4 shows a part of FIG. 3 on a larger scale.

The stronium 90 and its decay product respectively emit beta particles having energies of 0.5 and 2.24 Mev. giving a long life time of usefulness with moderate range. Since all of the beta particles emitted will not be at a given maximum energy level, and, since the distribution of energy levels vary the effectiveness of the beta particles to produce ionization varies approximately as illustrated in FIG. 2, illustrating the number of beta particles / energy level.

The surface to which the strontium 90 is applied can be any permanent surface on the vehicle, or it may be applied to a removable plate or the like to facilitate the servicing of the vehicle without danger of biological effects on personnel.

In jet aircraft one of the singular places for application is the jet intakes and exhaust. Radioactive substance can be applied to the thrust trimmers in these hot exhausts. An extra advantage of covering trimmers with radioactive substances is that a favorable condition is created for the condensation of water vapor into small droplets around electrons that will diminish the contrast against the blue skies and thus reduce visibility of condensation trails.

I claim:

1. A method for reducing the reflections of electromagnetic wave energy from material surfaces comprising applying to said material surface a radioactive substance for producing a cloud of electrons in the space enclosing said surface in sufficient quantity and so distributed as to produce a relatively uniform surface activity of an average value in the order of 10 cures per square centimeter.

2. A method for reducing the reflection of electromagnetic wave energy from a material surface comprising applying to said material surface a coating containing Strontium 90 in sufficient concentration to produce a surface activity of between 1 and 25 curies per square centimeter.

3. A method for reducing the reflections of electromagnetic wave energy from a material surface comprising applying to said material surface a coating of material containing polonium 210 in sufficient concentration to produce a surface activity in the order of 10 curies per square centimeter.

4. A method for reducing reflections of electromagnetic wave energy from flying objects, ballistic rockets and the like comprising applying to singular reflecting surfaces of said objects, a radioactive substance for creating in the space surrounding said objects a cloud of electrons having an average electron density of between $10^7$ and $10^{10}$ electrons per cubic centimeter.

5. In combination with a normally reflecting surface in a gaseous medium, a layer of substance for minimizing reflection of radio frequency waves, said layer comprising a coating of material containing a radioactive substance for ionizing the gaseous medium and creating a cloud of electrons to shroud the surface, varying in electron density inversely with distance from said surface the concentration of said substance being sufficient to produce a surface activity in the order of 10 curies per square centimeter.

6. In combination with an aircraft having normally reflecting surfaces to radio frequency electromagnetic waves, a coating at singular places on its reflecting surfaces, said coating comprising a substance containing a radioactive material for creating a cloud of electrons in space to shroud said aircraft and provie attenuation to said rdio frequency electromagnetic waves incident thereon the distribution and concentration of said radioactive material producing a relatively uniform surface activity whose average value is in the order of 10 curies per square centimeter.

7. The combination as defined in claim 6 wherein said radioactive substance is strontium 90.

8. The combination as defined in claim 6 wherei the radioactive material is polonium 210.

* * * * *